US008636032B2

(12) United States Patent
Burns et al.

(10) Patent No.: US 8,636,032 B2
(45) Date of Patent: Jan. 28, 2014

(54) ACOUSTICAL FLUID CONTROL MECHANISM

(75) Inventors: Mark A. Burns, Ann Arbor, MI (US); Sean M. Langelier, Ann Arbor, MI (US); Dustin S. Chang, Mt. Laurel, NJ (US)

(73) Assignees: National Institute of Health (NIH), Washington, DC (US); U.S. Dept. of Health and Human Services (DHHS), Washington, DC (US); U.S. Government of the United States as Represented by the NIH Division of Extramural Inventions and Technology Resources (DEITR), Washington, DC (US)

( * ) Notice: Subject to any disclaimer, the term of this patent is extended or adjusted under 35 U.S.C. 154(b) by 350 days.

(21) Appl. No.: 13/129,276

(22) PCT Filed: Nov. 13, 2009

(86) PCT No.: PCT/US2009/064374

§ 371 (c)(1), (2), (4) Date: Aug. 4, 2011

(87) PCT Pub. No.: WO2010/056984

PCT Pub. Date: May 20, 2010

(65) Prior Publication Data

US 2011/0277848 A1 Nov. 17, 2011

Related U.S. Application Data

(60) Provisional application No. 61/199,290, filed on Nov. 14, 2008.

(51) Int. Cl.
*F15C 1/04* (2006.01)

(52) U.S. Cl.
USPC ..... 137/828; 417/410.1; 417/410.2; 310/311; 310/321

(58) Field of Classification Search
USPC ..... 137/828; 417/410.1, 410.2; 310/300, 310/311, 321, 322
See application file for complete search history.

(56) References Cited

U.S. PATENT DOCUMENTS 5,579,399 A 11/1996 Lucas
5,690,145 A * 11/1997 Kuklinski et al. ..... 137/828

(Continued)

OTHER PUBLICATIONS

Bohm et al, "A Plastic Micropump Constructed With Conventional Techniques and Materials", Sensors and Actuators, 1999, pp. 223-228. vol. 77.
Chan et al., "High-Temperature Microfluidic Synthesis of CdSe Nanocrystals in Nanoliter Droplets", J. Am Chem. Soc, 2005, pp. 13854-13861, vol. 127, No. 40.
Chang et al., "An Electronic Venturi-Based Pressure Microregulator", Lab on a Chip, 2007, pp. 1791-1799, vol. 7.

(Continued)

*Primary Examiner* — Eric Keasel
*Assistant Examiner* — Minh Le
(74) *Attorney, Agent, or Firm* — Howard & Howard Attorneys PLLC

(57) ABSTRACT

An acoustical fluid control mechanism and a method of controlling fluid flow of a working fluid with the acoustical fluid control mechanism are provided. The mechanism comprises a resonance chamber that defines a cavity. The resonance chamber has a port. The cavity is sealed from the ambient but for the port for enabling oscillatory flow of a working fluid into and out of the cavity upon exposure of the resonance chamber to an acoustic signal containing a tone at a frequency that is substantially similar to a particular resonance frequency of the resonance chamber. The mechanism further includes a rectifier for introducing directional bias to the oscillatory flow of the working fluid through the port. The rectifier has an inlet connected to the port and an outlet for transmitting the directional flow of the working fluid away from the cavity. The outlet is in fluid communication with the port of the resonance chamber at least during transmission of the directional flow of the working fluid therethrough.

20 Claims, 6 Drawing Sheets

(56) References Cited

U.S. PATENT DOCUMENTS

| | | | | |
|---|---|---|---|---|
| 6,467,350 | B1 | 10/2002 | Kaduchak et al. | |
| 6,568,052 | B1 * | 5/2003 | Rife et al. | 29/25.35 |
| 6,638,032 | B1 * | 10/2003 | Vanden Brande et al. | 417/322 |
| 6,669,454 | B2 * | 12/2003 | Lal et al. | 417/410.2 |
| 2002/0124879 | A1 * | 9/2002 | Kaplan et al. | 137/13 |
| 2002/0179162 | A1 * | 12/2002 | Lal et al. | 137/828 |
| 2005/0194206 | A1 | 9/2005 | Rose et al. | |
| 2006/0096353 | A1 | 5/2006 | Hawkes et al. | |
| 2007/0012334 | A1 * | 1/2007 | Wolters | 134/1 |
| 2008/0191581 | A9 * | 8/2008 | Penner et al. | 310/311 |
| 2010/0224274 | A1 * | 9/2010 | Tokita et al. | 137/826 |

OTHER PUBLICATIONS

Chen et al., "A Planar Electroosmotic Micropump", Journal of Microelectromechanical Systems, 2002, pp. 672-683, vol. 11, No. 6.
Cho et al., "Creating, Transporting, Cutting, and Merging Liquid Droplets by Electrowetting-Based Actuation for Digital Microfluidic Circuits", Journal of Microelectromechanical Systems, 2003, pp. 70-80, vol. 12, No. 1.
Dijkink et al., "The Acoustic Scallop: A Bubble-Powered Actuator", Journal of Micromechanics and Microengineering, 2006, pp. 1653-1659, vol. 16.
Eddings et al., "A PDMS-Based Gas Permeation Pump for On-Chip Fluid Handling in Microfluidic Devices", Journal of Micromechanics and Microengineering, 2006, pp. 2396-2402, vol. 16.
Fletcher, et al., "Micro Reactors: Principles and Applications in Organic Synthesis", Tetrahedron, 2002, pp. 4735-4757, vol. 58.
Greenway et al., "The Use of a Novel Microreactor for High Throughput Continuous Flow Organic Synthesis", Sensors and Actuators B, 2000, pp. 153-158, vol. 63.
Groisman et al., "A Microfluidic Rectifier: Anisotropic Flow Resistance at Low Reynolds Numbers", Physical Review Letters, 2004, pp. 094501-1-094501-4, vol. 92, No. 9.
Grover et al., "Monolithic Membrane Valves and Diaphragm Pumps for Practical Large-Scale Integration Into Glass Microfluidic Devices", Sensors and Actuators B, 2003. pp. 315-323, vol. 89.
Guttenberg et al., "Planar Chip Device for PCR and Hybridization With Surface Acoustic Wave Pump", Lab on a Chip, 2005, pp. 308-317, vol. 5.
Hagsater et al. "Acoustic Resonances in Microfluidic Chips: Full-Image Micro -PIV Experiments and Numerical Simulations", Lab on a Chip, 2007, pp. 1336-1344, vol. 7.
Jang et at al. "Microfluidic Circulatory Flows Induced by Resonant Vibration of Diaphragms", Sensors and Actuators A, 2005, pp. 141-148, vol. 122.
Jeong et al., "Fabrication and Test of a Thermopneumatic Micropump With a Corrugated P + Diaphragm", Sensors and Actuators, 2000, pp. 249-255, vol. 83.
Koch et al., "A Novel Micromachined Pump Based on Thick-Film Piezoelectric Actuation", Sensors and Actuators A, 1998, pp. 98-103, vol. 70.
Kurosawa et al., "Surface Acoustic Wave Atomizer", Sensors and Actuators A, 995, pp. 69-74, vol. 50.
Laser et al., "A Review of Micropumps", Journal of Micromechanics and Microengineering, 2004, R35-R64, vol. 14.
Lighthill, "Acoustic Streaming", Journal of Sound and Vibration, 1978, pp. 391-418, vol. 61(3).
Manz et al., "Electroosmotic Pumping and Electrophoretic Separations for Miniaturized Chemical Analysis Systems", Journal of Micromechanics and Microengineering, 1994, pp. 257-265, vol. 4.
Nguyen et al., "Integrated Flow Sensor for in Situ Measurement and Control of Acoustic Streaming in Flexural Plate Wave Micropumps", Sensors and Actuators, 2000, pp. 115-121, vol. 79.
Olsson et al., "A Valve-Less Planar Fluid Pump With Two Pump Chambers", Sensors and Actuators, A, 1995, pp. 549-556, vol. 46-47.
Olsson et al., "Micromachined Flat-Walled Valveless Diffuser Pumps", Journal of Microelectromechanical Systems, 1997, pp. 161-166, vol. 6, No. 2.
Pal et al., "An Integrated Microfluidic Device for Influenza and Other Genetic Analyses", Lab on a Chip, 2005, pp. 1024-1032, vol. 5.
Petersson, et al., "Free Flow Acoustophoresis: Microfluidic-Based Mode of Particle and Cell Separation", Analytical Chemistry, 2007, pp. 5117-5123, vol. 79, No. 14.
Pregibon et al., "Multifunctional Encoded Particles for High-Throughput Biomolecule Analysis", Science, 2007, pp. 1393-1396, vol. 315.
Puskar et al., "Raman Acoustic Levitation Spectroscopy of Red Blood Cells and Plasmodium Falciparum Trophozoites", Lab on a Chip, pp. 1125-1131, vol. 7.
Richter et al., "Robust Design of Gas and Liquid Micropumps", Sensors and Actuators, A, 1998, pp. 480-486, vol. 68.
Rife et al., "Miniature Valveless Ultrasonic Pumps and Mixers", Sensors and Actuators, 2000, pp. 135-140, vol. 86.
Schneider et al., "Shear-Induced Unfolding Triggers Adhesion of von Willebrand Factor Fibers", Proceedings of the National Academy of Sciences of the United States of America, 2007, pp. 7899-7903, vol. 104, No. 19.
Sritharan et al., "Acoustic Mixing At Low Reynold's Numbers", Applied Physics Letters, 2006, p. 054102-1, vol. 88.
Teh et al., "Droplet Microfluidics", Lab on a Chip, 2008, pp. 198-220, vol. 8.
Tesar, "Configurations of Fluidic Actuators for Generating Hybrid-Synthetic Jets", Sensors and Actuators A, 2007, pp. 394-403, vol. 138.
Unger et al., "Monolithic Microfabricated Valves and Pumps by Multilayer Soft Lithography", Science, 2000. pp. 113-116, vol. 288.
Van Lintel et al. "A Piezoelectric Micropump Based on Micromachining of Silicon", Sensors and Actuators, 1988, pp. 153-167, vol. 15.
Wixforth, "Acoustically Driven Planar Microfluidics", Superlattices and Microstructures, 2003, pp. 389-396, vol. 33.
Zheng et al., "Formation of Droplets of Alternating Composition in Microfluidic Channels and Applications to Indexing of Concentrations in Droplet-Based Assays", Analytical Chemistry, 2004, pp. 4977-4982, vol. 76, No. 17.
International Preliminary Report, PCT/US2009/064374, May 17, 2011, 4 pages.

* cited by examiner

ACOUSTICAL FLUID CONTROL MECHANISM

CROSS-REFERENCE TO RELATED APPLICATIONS

This application claims priority to and all the advantages of International Patent Application No. PCT/US2009/064374 filed on Nov. 13, 2009, which claims priority to U.S. Provisional Patent Application No. 61/199,290, filed on Nov. 14, 2008.

GOVERNMENT LICENSING RIGHTS

This invention was made with government support under grant number AI049541 awarded by the National Institute of Health. The government has certain rights in the invention.

BACKGROUND OF THE INVENTION

1. Field of the Invention

The instant invention generally relates to a fluid control mechanism by which the frequency constituents within an acoustic signal are converted to a useful working output. More specifically, the instant invention relates to a fluid control mechanism including a resonance chamber that produces oscillatory flow of a working fluid in response to exposure to an acoustic signal.

2. Description of the Related Art

A wide variety of actuating technologies have been developed for use in miniaturized systems for the life sciences including integrated microfluidic system. For example, the integrated microfluidic systems may be used to produce microgradients of liquid reagents and samples. The microgradients of the liquid reagents and samples may be utilized for understanding many of nature's developmental processes.

Control and transport of the liquid reagents and samples are difficulties that are often encountered with the integrated microfluidic systems. Most known integrated microfluidic systems rely heavily upon external liquid or air pressure to transport the liquid reagents and samples between dedicated fluidic unit operations in the systems. Use of the external liquid or air pressure often requires the use of extensive external control equipment, and difficulties with control of fluid flow often arise due to the use of multiple pumps dedicated to each fluidic unit.

Manipulation or control of discrete fluid droplets has been performed using air pressure with careful attention paid to a magnitude of the pressure gradient as most pressure regulators are not configured or designed to output minute pressure differences that are needed for precise in vivo droplet control. A related approach to droplet control employs intermittent pulsing of a coarsely regulated pressure source to precisely position droplets. Another approach that has been taken with regard to distributed pressure control utilizes micro-machined Venturi pressure regulators. Hybrid schemes employing both displacement and direct pressure are also possible, most notably, for use in serial deflection of elastomeric membranes. With this approach, multiplexed pressure control is feasible, but the number of external connections and control equipment required to operate a reasonably complex integrated microfluidic system is prohibitively large in size, and such an approach also requires high power actuation schemes.

The dependence on external liquid or air pressure is becoming increasingly problematic with the push towards integrated microfluidic systems, which can include thousands of independent pressure regulators. Additionally, the lack of low power actuation schemes has, in part, hindered the use of the systems for various applications.

Fluid control schemes that utilize acoustics are known in areas ranging from fluid transport, mixing, separations, and droplet levitation. Two relevant fluid control schemes utilizing acoustics are acoustic streaming and surface acoustic waves (SAW). Acoustic streaming, also known as quartz wind, is a phenomenon by which a steady momentum flux is imparted to a fluid due to the impingement of high amplitude acoustic waves. Bulk motion of the fluid results from a build up of a non-linear viscous Reynolds stress. However, due to an intolerance to back pressure, microfluidic applications using acoustic streaming have thus far been limited primarily to driving closed-loop fluid circuits. SAWs, on the other hand, operate principally on an open planar surface rather than within a closed channel. Surface confined acoustic waves can be launched within piezoelectric substrates by applying resonant frequencies to sets of interdigitated electrodes with the resonance frequencies determined by electrode spacing. SAWs are launched perpendicular to the electrodes and decay rapidly with substrate depth but decay negligibly in the direction of propagation. Surface bound droplets in the path of a SAW undergo a rolling motion due to acoustic streaming that occurs at a leading pinned meniscus of the droplet. As such, SAWs can be used to position droplets arbitrarily along lines of intersecting electrode paths.

One limitation to the use of SAWs, in addition to potential limitations introduced from use of an open platform (such as reagent and sample storage, evaporation losses, contamination), is fabricating the numbers of electrodes necessary for precise droplet placement.

Another type of fluid control scheme that utilizes acoustics is an acoustic compressor. In acoustic compressors, the exposure of a resonance chamber to an acoustic signal containing a tone at a frequency that is substantially similar to the resonance frequency of the resonance chamber creates pressure oscillations within a gas-filled cavity of the resonance chamber. These pressure oscillations have been typically converted into compression and flow by reed valves that are attached to the resonance chamber. The gas oscillates back and forth in the cavity, alternately compressing and rarifying the gas. The displacement of this gas can be changed by varying the power input, thus resulting in variable pumping capacity. However, the acoustic compressors require an inlet and an outlet to the resonance chamber to avoid buildup of pressure in the resonance chamber. Further, the acoustic compressors generally require a large size of the cavity to keep the operating frequencies within the range of practical reed valves. As such, acoustic compressors tend to be physically large for a given pumping capacity, when compared to other types of compressors, which is especially detrimental for microfluidic systems.

Due to the deficiencies of known schemes used to control fluid flow in integrated microfluidic systems, there is an opportunity to develop new schemes that overcome such deficiencies.

SUMMARY OF THE INVENTION AND ADVANTAGES

The subject invention provides an acoustical fluid control mechanism and a method of controlling fluid flow of a working fluid with the acoustical fluid control mechanism. The mechanism comprises a resonance chamber that defines a cavity. The resonance chamber has a port. The cavity is sealed from the ambient but for the port for enabling oscillatory flow of a working fluid into and out of the cavity upon exposure of the resonance chamber to an acoustic signal containing a tone at a frequency that is substantially similar to a particular resonance frequency of the resonance chamber. The mechanism further includes a rectifier for introducing directional bias to the oscillatory flow of the working fluid through the port. The rectifier has an inlet connected to the port of the resonance chamber for receiving the oscillatory flow of the working fluid from the port. The rectifier further includes an outlet for transmitting the directional flow of the working fluid away from the cavity. The outlet is in fluid communication with the port of the resonance chamber at least during transmission of the directional flow of the working fluid therethrough.

The method of controlling fluid flow of the working fluid with the acoustical fluid control mechanism includes the step of exposing the resonance chamber to an acoustic signal containing a tone at a particular frequency of the resonance chamber to produce oscillatory flow of the working fluid into and out of the cavity of the resonance chamber through the port, with the rectifier thereby introducing directional bias to the oscillatory flow of the working fluid through the port. As a result of the rectifier introducing directional bias to the oscillatory flow of the working fluid, the directional flow of the working fluid is transmitted away from the cavity and through the outlet of the rectifier.

The mechanism provided herein presents many advantages. For example, the resonance chamber has a particular resonance frequency at which oscillatory flow of the working fluid is maximized. In this regard, the directional flow of the working fluid transmitted through the outlet of the rectifier connected thereto can be precisely controlled by providing an acoustic signal containing a tone at a frequency that is either substantially similar to or substantially different than the resonance frequency of the resonance chamber. Further, a bank of resonance chambers can be provided, with each resonance chamber having a sufficiently different resonance frequency to enable precise control of the conditions under which directional flow of the working fluid is transmitted through the outlets of rectifiers connected to the respective resonance chambers by simply controlling tones contained in the acoustic signal. Because each resonance chamber has a particular resonance frequency near which oscillatory flow of the working fluid can be maximized, directional flow attributable to a particular resonance chamber can be effectuated while substantially eliminating directional flow that would be attributable to other resonance chambers by controlling the frequency and amplitude of a particular tone or combination of tones contained by the acoustic signal at any point in time.

BRIEF DESCRIPTION OF THE FIGURES

Other advantages of the present invention will be readily appreciated, as the same becomes better understood by reference to the following detailed description when considered in connection with the accompanying drawings wherein:

FIG. 2(*a*) is an acoustic resonance spectrograph representing the acoustic response of various resonance chambers when exposed to an acoustic signal containing tones at a steadily ramped frequency at constant amplitude. Resonance chambers 1-4 have a resonance frequency at 404 Hz, 484 Hz, 532 Hz and 654 Hz respectively. FIG. 2(*b*) illustrates two-dimensional FEM results for a resonance chamber having a resonance frequency at 860 Hz, illustrating the effect of radiation loss on the quality of resonance, Q, for aspect ratios of a diameter of the resonance chamber to a diameter of the port of 2.3, 4.6, 7.7, 11.5, and 23;

DETAILED DESCRIPTION OF THE INVENTION

Figure 1:
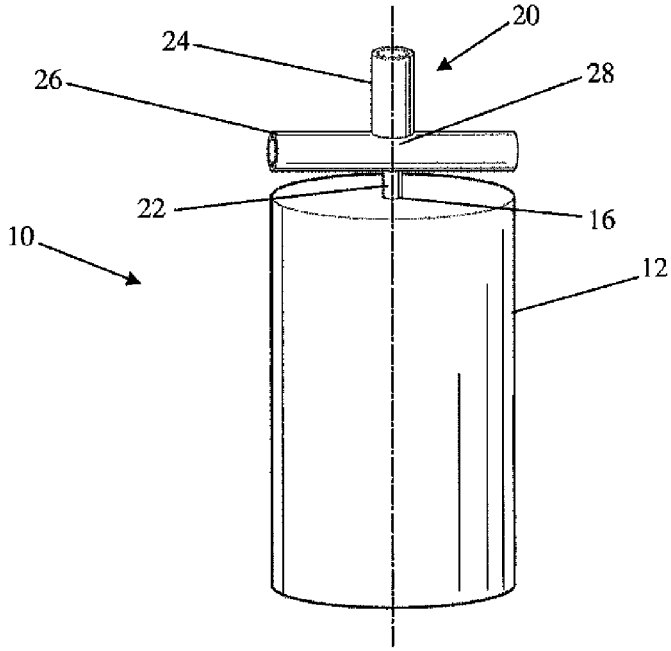
FIG. 1 is a perspective schematic view of the acoustical fluid control mechanism comprising a resonance chamber and a rectifier connected thereto.
Figure 6:
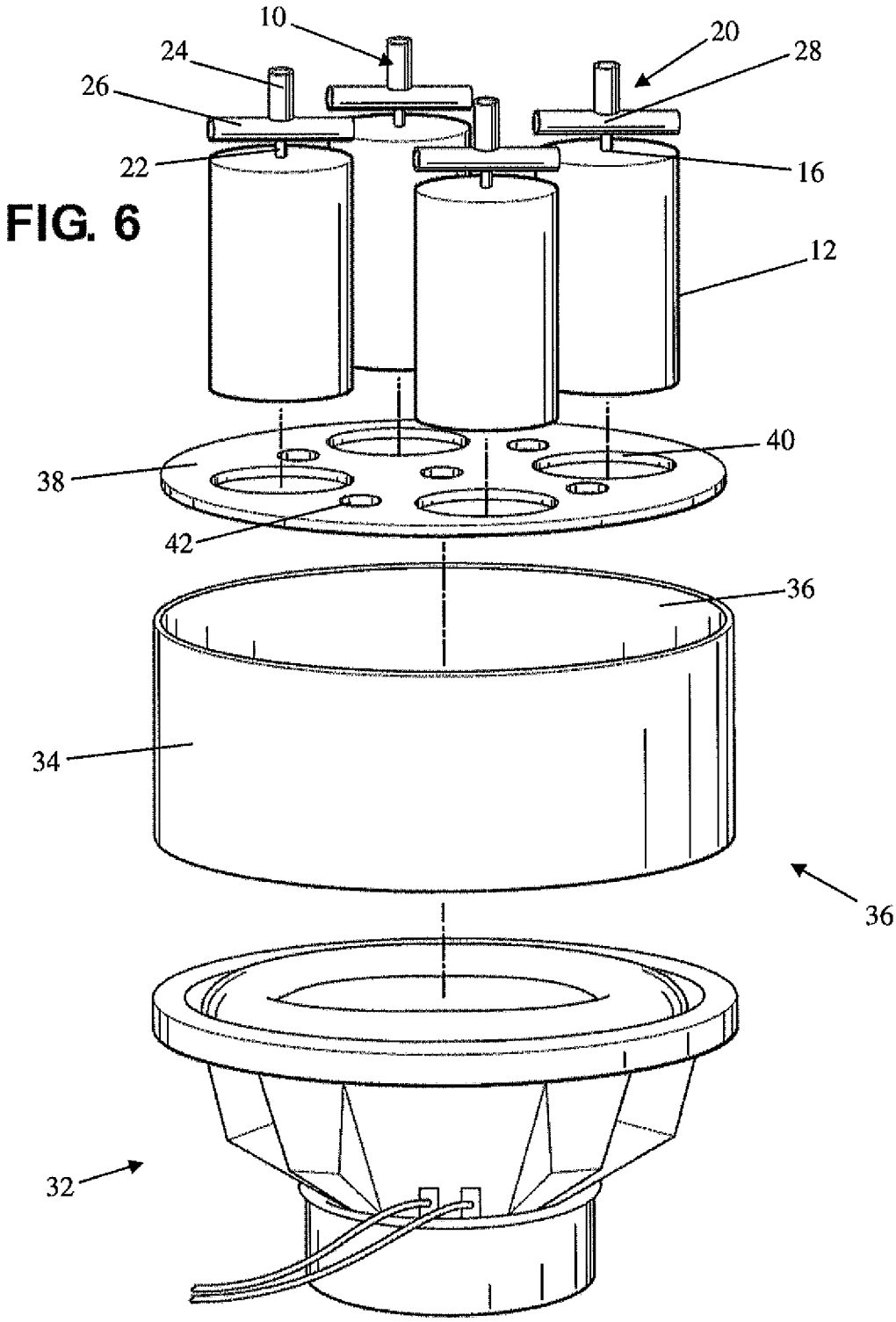
FIG. 6 is an exploded perspective schematic view of an embodiment of the acoustical fluid control mechanism comprising an acoustic source, a common air chamber, a vented cover plate, and four resonance chambers with rectifiers attached thereto.

Referring to the Figures, wherein like numerals indicate like or corresponding parts, an acoustical fluid control mechanism 10 is generally shown at 10 in FIG. 1. The acoustical fluid control mechanism 10 of the instant invention includes a resonance chamber 12 and, more typically, includes a bank of resonance chambers 12 as shown in FIG. 6. Each resonance chamber 12 defines a cavity 14. The resonance chamber 12 (or bank of resonance chambers 12) is designed using principles of resonance and has a geometry that corresponds to a particular resonance frequency. For example, the resonance chamber(s) 12 can be designed using principles of standing wave resonance or Helmholtz resonance, both of which are known in the art. As also known in the art, "resonance frequency" refers to a frequency at which a system tends to oscillate at a larger amplitude than at other frequencies, and typically represents the frequency or frequencies at which maximum oscillation of the system occurs due to principles of standing wave resonance. When the bank of acoustic resonance chamber 12 is used, the resonance chambers 12 have different resonance frequencies, with differences between the resonance frequencies of the various resonance chambers 12 engineered to avoid peak overlap. In one embodiment, a peak resonance frequency of any of the resonance chambers 12 is different by at least 10 Hz from a peak resonance frequency of any other of the resonance chambers 12. Typically, the resonance chambers 12 used in accordance with the instant invention are quarter-wavelength resonance chambers 12, which have a resonance frequency at a wavelength that is equal to four times an axial length of the cavity 14 (in metric units) in the resonance chamber 12. The resonance frequency of the resonance chambers 12 is not limited to any particular value or range, with useful resonance frequencies dependent upon factors such as size constraints of the resonance chamber 12 required for a given application. However, in one example, the resonance chamber(s) 12 has/have a resonance frequency in a range of from about 400 to about 1250 Hz. When the bank of resonance chambers 12 is used, each resonance chamber 12 typically responds to exactly one narrow non-overlapping band of frequencies within a range of resonance frequencies. For example, when the range of resonance frequencies is from about 400 to about 1250 Hz as set forth above, the resonance chambers 12 may have resonance frequencies having an average peak width of about 21+/−10 Hz, with differences in peak resonance frequencies between any of the resonance chambers 12 typically being at least 10 Hz. The spacing of the non-overlapping band of frequencies determines, for a limited frequency range, the number of possible independent pressure lines that can be controlled. For example, by using an average peak width of 21+/−10 Hz, the number of resonance chambers 12 that can theoretically be controlled within the range of resonance frequencies set forth above is 38+/−18. As such, the bank of resonance chambers 12 that operate within the band of frequencies of from about 400 to about 1250 Hz may include up to about 56 individual resonance chambers 12.

The resonance chambers 12 may be in the form of cylinders, but it is possible that the resonance chambers 12 can have other shapes, such as a rectangular box shape, depending upon the intended use of the acoustical fluid control mechanism 10. Material used to form the resonance chambers 12 is somewhat insignificant. However, the resonance chambers 12 are typically formed from a relatively rigid material such as glass, silicon, or rigid polymeric materials that will reflect and not attenuate incident sound waves. In one specific example, the resonance chambers 12 may be formed from borosilicate glass. The resonance chambers 12 are not limited to any particular size. However, it is notable that the resonance chambers 12 are useful in microfluidic systems and, therefore, may have relatively small sizes. For example, in accordance with specific embodiments of the acoustical fluid control mechanism 10 of the instant invention, the resonance chambers 12 may be formed from 47 mm ID, 51 mm OD, borosilicate tube stock cut to 192 mm, 156 mm, 141 mm, and 111 mm respectively (for a mechanism 10 in which the bank of resonance chambers 12 are utilized as shown in FIG. 6). It is also to be appreciated that the resonance chambers 12 can be scaled down for use in the microfluidic systems.

Each resonance chamber 12 has a port 16, with the cavity 14 sealed from the ambient but for the port 16 for enabling oscillatory flow of a working fluid, such as a gas or liquid, into and out of the cavity 14 upon exposure of the resonance chamber 12 to an acoustic signal 18 containing a tone at a particular frequency that is substantially similar to the resonance frequency of the resonance chamber 12. The acoustic signal 18, as used herein, is a mechanical vibration propagated through a medium and need not be audible to the human ear. The frequency of the tone is dependent upon the resonance frequency of the corresponding resonance chamber 12. Thus, for the example provided above in which the resonance chamber(s) 12 has/have resonance frequencies within the range of about 400 to about 1250 Hz, the acoustic signal 18 contains the tone or tones within the frequency range of from about 400 to about 1250 Hz. For purposes of the instant application, a frequency that is "substantially similar" to the resonance frequency of a particular resonance chamber 12 refers to a frequency that is sufficient to effectuate oscillation of the working fluid into and out of the port 16 of the resonance chamber 12. Typically, the "substantially similar" frequency refers to a frequency within about 5+/−Hz of the peak resonance frequency of the resonance chamber 12. However, it is to be appreciated that the frequency of the tone that is necessary to effectuate oscillation may be dependent upon various factors, such as quality of resonance. Quality of resonance is described in further detail below.

Figure 2:
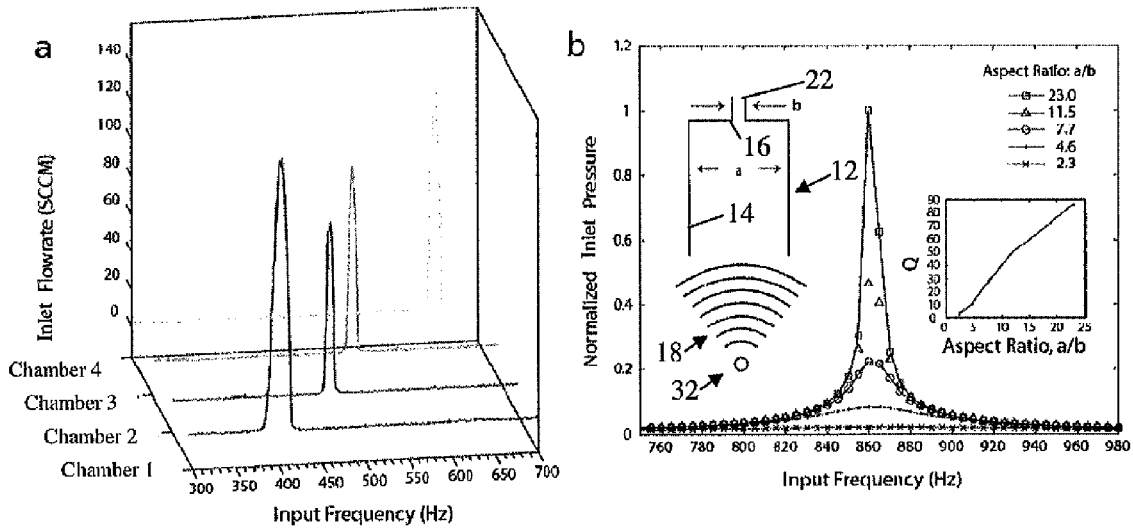
FIG. 2 provides two graphs that illustrate exemplary resonance properties of the acoustical fluid control mechanism.

Oscillation of the resonance chamber 12 results in oscillatory flow into and out of the cavity 14 through the port 16 due to pressure differentials created by the oscillation of the resonance chamber 12. While the port 16 is typically located along a center axis of the resonance chamber 12 in the direction of a longest dimension thereof, the instant invention is not limited to a particular location of the port 16. A size of the port 16 is dependent upon the size of the resonance chamber 12, and the operative metric is generally a ratio of a cross-sectional area of the resonance chamber 12 to a cross-sectional area of the port 16. The "cross-sectional area" refers to the cross-sectional area of the portions of the resonance chamber 12 and the port 16 bound by inner surfaces thereof. In other words, the "cross-sectional area of the resonance chamber 12" effectively refers to the cross-sectional area of the cavity 14 that is defined by the resonance chamber 12. FIG. 2 illustrates the significance of the ratio of the cross-sectional area of the resonance chamber 12 to the cross-sectional area of the port 16 as it relates to normalized port 16 pressure during oscillatory flow therethrough, with higher ratios corresponding to higher normalized pressures out of the port 16. Resonance spectrographs, shown in FIG. 2*a*, were created to identify the location of the resonance frequency of sample resonance chambers 12. The emergence of highly amplified spikes in outlet 24 flow corresponds to a standing wave resonance event 26 unique to each resonance chamber 12. FIG. 2(*b*) illustrates the results of two-dimensional finite element analysis (FEM) based upon the variables "a" and "b", which correspond to the diameters of the resonance chamber 12 and the port 16, assuming perfectly circular shapes for both the resonance chamber 12 and the port 16. The ratio of the cross-sectional area of the resonance chamber 12 to the cross-sectional area of the port 16 has an effect on quality of resonance, Q, as illustrated in the inset of FIG. 2(*b*). As known in the art, higher Q values correlates to a lower rate of energy loss relative to the stored energy of the resonance chamber 12 during oscillation thereof; the oscillations die out more slowly. As such, higher Q values correlate to sharp resonance peaks and a requirement of less power of the acoustic signal 18 to achieve oscillation in the resonance chamber 12. Therefore, high Q values contribute to enhanced performance of the acoustical fluid control mechanism 10, which may be a particularly important consideration when the acoustical fluid control mechanism 10 is used in microfluidic systems. The ratio of the cross-sectional area of the resonance chamber 12 to the cross-sectional area of the port 16 is typically at least 4.0:1, more typically from about 4.6 to about 25, for purposes of maximizing the Q value. In one specific example, such as for the specific resonance chambers 12 set forth above having an inner diameter of 47 mm, the port 16 may have an inner diameter of about 2 mm and an outer diameter of about 6 mm, which results in a high ratio of "a" to "b" of about 23.5.

Referring to FIG. 1, the acoustical fluid control mechanism 10 also includes a rectifier 20 for introducing directional bias to the oscillatory flow of the working fluid through the port 16. The rectifier 20 has an inlet 22 connected to the port 16 of the resonance chamber 12 for receiving the oscillatory flow of the working fluid from the port 16 to form a resonance chamber 12-rectifier 20 pair. The "port 16", as referred to herein and as shown in the Figures, refers to an opening defined in the resonance chamber 12, while the "inlet 22", as referred to herein and as shown in the Figures, generally refers to external structures that extend from the resonance chamber 12. However, it is to be appreciated that the resonance chamber 12 may include external structures that facilitate connection of the inlet 22 of the rectifier 20 to the port 16 of the resonance chamber 12, such as the schematic structure shown in the inset of FIG. 2(*b*). The rectifier 20 also has an outlet 24 for transmitting the directional flow of the working fluid away from the cavity 14. The directional bias is the result of the imposition of less hydraulic resistance to the oscillatory flow of the working fluid in one direction, such as in the direction away from the cavity 14 in the context of the instant invention, to thereby introduce the directional bias to the oscillatory flow of the working fluid. The directional bias can be introduced either mechanically, such as through use of a check or flap valve (not shown), or by utilizing physical properties of the working fluid. Regardless of how the directional bias is imposed, the outlet 24 is in fluid communication with the port 16 of the resonance chamber 12 at least during transmission of the directional flow of the working fluid therethrough. In other words, directional flow of the working fluid through the outlet 24 is not the result of oscillatory actuation of a diaphragm, but rather the directional flow of the working fluid represents propagation of the fluid flow from the port 16 of the resonance chamber 12 through the rectifier 20.

Referring primarily to FIG. 3, in one embodiment the rectifier 20 is further defined as an inertial fluidic rectifier 20, in which hydraulic resistance is reduced by way of a vent 26. More specifically, in this embodiment, the rectifier 20 includes an intersecting junction 28 with the inlet 22, the outlet 24, and the vent 26 meeting at the intersecting junction 28. The vent 26 is typically open to the ambient for enabling free flow of the working fluid into and out of the rectifier 20. While FIGS. 3*a* through 3*d* each illustrate the rectifier 20 as having two vents 26, it is to be appreciated that the rectifier 20 may include a single vent 26 without compromising operation thereof. In the embodiments of FIGS. 3*a* through 3*d*, the inlet 22 and outlet 24 are disposed opposite to each other across the intersecting junction 28, and the two vents 26 are also disposed opposite each other across the junction 28. Referring to FIG. 3*a*, in one embodiment, the inlet 22 of the rectifier 20 has a smaller cross-sectional area than the outlet 24, which results in higher Q values under some circumstances. However, it is to be appreciated that the inlet 22 may have the same cross-sectional area as the cross-sectional area of the outlet 24 as shown in FIG. 3*b*. In any event 26, a ratio of cross-sectional area of the inlet 22 to cross-sectional area of the outlet 24 is typically from about 0.1:1 to about 1:1, alternatively from about 0.5:1 to about 1:1. The inlet 22 typically has the same cross-sectional area as the port 16, and typically has a constant cross-sectional area along the length thereof. However, it is to be appreciated that the inlet 22 may be tapered in some embodiments, as shown in FIG. 3*c*. In one specific example, the inlet 22 may have a constant cross-sectional area with an inner diameter of about 2 mm which extends slightly into the confluence of a three way intersecting junction 28 formed from fusing three lengths of 4 mm ID, 6 mm OD glass tubing, with the three lengths of 4 mm ID tubing forming two vents 26 and the outlet 24.

Figure 3A:
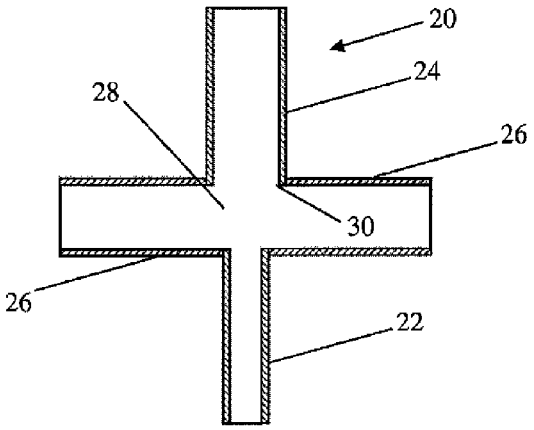
FIG. 3 illustrates various embodiments of rectifiers in accordance with the instant invention, with each rectifier having an intersecting junction with an inlet, an outlet, and a pair of vents meeting at the intersecting junction and with the inlet and outlet disposed opposite to each other across the intersecting junction.
Figure 3B:
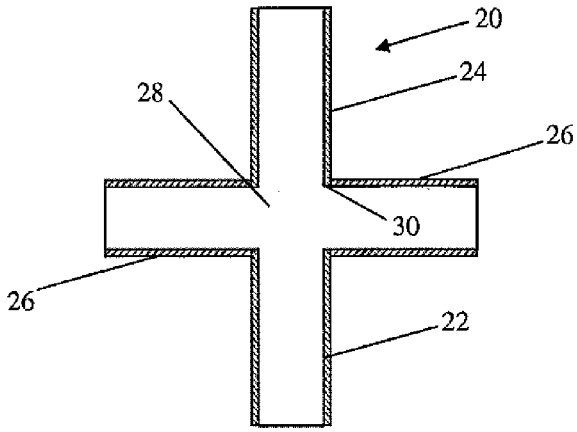
Figure 3C:
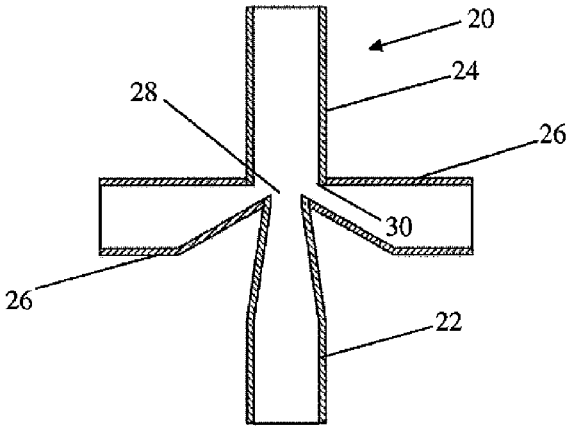
Figure 3D:
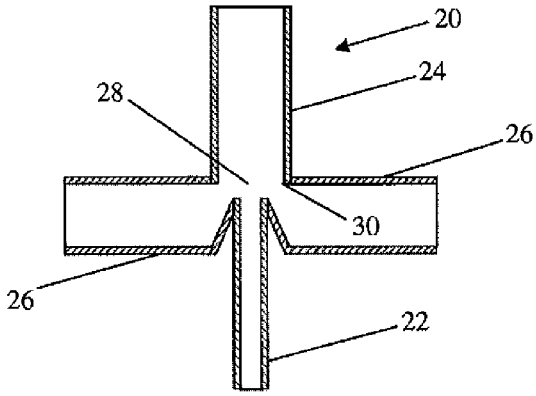

While there are no particular limitations as to the size or dimensions of the vent 26, a cross-sectional area of a mouth 30 of the vent 26 that opens to the intersecting junction 28 is typically about equal to the cross-sectional area of the outlet 24. However, as shown in FIGS. 3*c* and 3*d*, it is to be appreciated that the cross-sectional area of the mouth 30 of the vent 26 can be smaller than the cross-sectional area of the outlet 24. Typically, a ratio of cross-sectional area of the mouth 30 of the vent 26 to cross-sectional area of the outlet 24 is from about 0.1:1 to about 1:1. When lower ratios of cross-sectional area of the mouth 30 of the vent 26 to cross-sectional area of the outlet 24 are employed, the amount of accumulated flow transferred to the outlet 24 of the rectifier 20 during oscillatory flow is lessened as more of the working fluid during the expansion portion of the oscillatory cycle is supplied by the outlet 24 port 16. As such, it is desirable to maximize the cross-sectional area of the mouth 30 of the vent 26 to the cross-sectional area of the outlet 24, while ensuring that the ratio is not so high as to prevent 26 the working fluid from flowing into the outlet 24, which flow dynamics are described in further detail below.

Resistance to flow of the working fluid from the inlet 22 into the intersecting junction 28 is minimized by providing the vent 26 and the outlet 24 having the cross-sectional area that is at least equal to the cross-sectional area of the inlet 22. As such, the working fluid flows relatively easily into the intersecting junction 28 from the inlet 22 as compared to flow of the working fluid from the outlet 24 into the intersecting junction 28. More specifically, upon compression of the resonance chamber 12, the working fluid is forced out of the cavity 14 through the port 16 and into the inlet 22 of the rectifier 20. During expansion of the resonance chamber 12, the working fluid is pulled back into the cavity 14 of the resonance chamber 12 through the inlet 22 and the port 16. Due to the presence of the vent 26, working fluid is available to the inlet 22 from both the vent 26 and the outlet 24 during expansion of the resonance chamber 12, resulting in less working fluid flowing into the inlet 22 from the outlet 24 as compared to fluid flowing into the outlet 24 from the inlet 22 during compression of the resonance chamber 12. Such flow dynamics are exploited to result in accumulated flow toward the outlet 24, thereby introducing the directional bias to the oscillatory flow of the working fluid into and out of the cavity 14.

Due to the presence of the vent 26, fluid flow of the working fluid is engineered to direct flow of the working fluid into the outlet 24 across the intersecting junction 28 instead of into the vent 26. In this regard, the relative positions of the inlet 22, outlet 24, and vent 26 are relevant. To explain, oscillatory flow of the working fluid may have an inertial dominant flow field based upon a number of factors including dimensions of the resonance chamber 12 and inlet 22 of the rectifier 20, as well as the strength of the acoustic signal 18. The inertial dominant flow field may be quantified by a Reynold's number, which is indicative of a ratio of the inertial forces compared to viscous forces. The inertial dominant flow field typically has a high Reynold's number of at least 1, alternatively at least 10, alternatively at least 100. The inertial dominant flow field has a unique property in that it resists turning corners. As such, when the inlet 22 and outlet 24 are disposed opposite to each other across the intersecting junction 28, the inertia of the working fluid flowing through the inlet 22 at the high Reynold's number forms a synthetic jet of the working fluid across the intersecting junction 28 and into the outlet 24, while bypassing the vent 26 or vents 26. Such phenomenon can be observed in the bottom vertically tiled image on the right side of FIG. 4.

Figure 4:
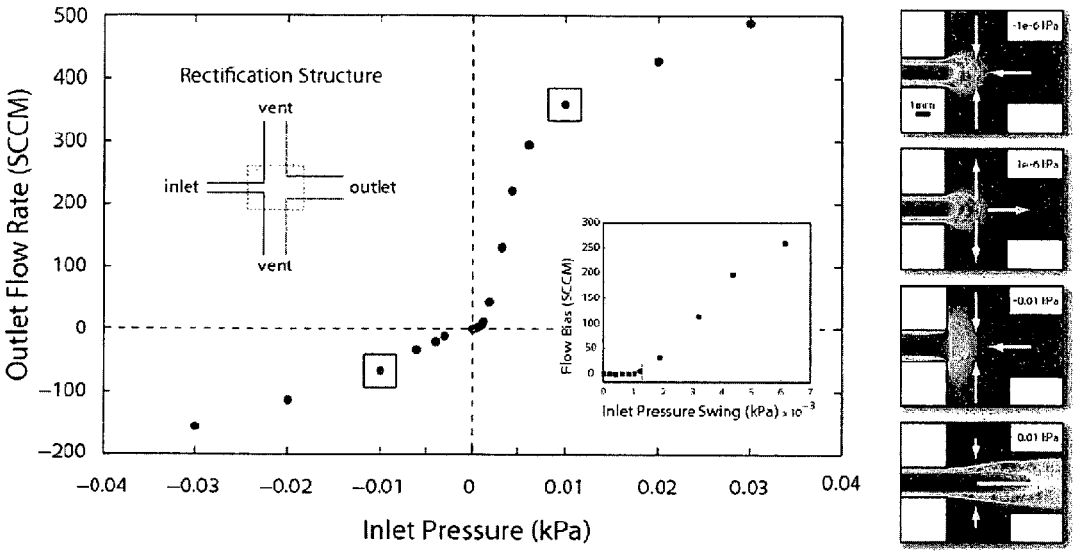
FIG. 4 provides a graph illustrating directional asymmetry of the rectifier shown in FIG. 3*a*; known pressure loads were applied to the inlet of the rectifier, outlet flow rate versus inlet pressure shows the marked asymmetry, as shown by the shaded rectangles, across zero gauge pressure. The vertically tiled images on the right side of FIG. 4 are pictorial representations of two-dimensional incompressible flow simulation results illustrating rectifier asymmetry in terms of a difference in flow field. The top two images show a reversible viscous dominant flow field for a pressure load of $1e^{-6}$ kPa. The bottom two images, illustrating an inertial dominant flow field, reflect the emergence of an asymmetry in the flow field already well established at a pressure load of 0.01 kPa. Asymmetry results from flow separation and jetting due the build up of adverse pressure at a mouth of the inlet into an intersecting junction.

Both experimental (represented by the graph on the left side of FIG. 4) and simulated performance (represented by the vertically tiled images on the right side of FIG. 4) of the inertial fluidic rectifier 20 is illustrated in terms of fluid outflow rate from the rectifier 20 when subjected to equidistant pressures on either side of zero gauge pressure (the term "pressure swing" will henceforth be used to describe such a pair of pressures equidistant from zero gauge pressure). For positive gauge pressures, air may be supplied through the vent 26(*s*) using a mass flow controller (MKS, 11598B-05000SV). For negative gauge pressure, a vacuum may be applied through the vent 26(*s*) using a two stage vacuum regulator in conjunction 28 with a vacuum source 32. In each case, pressure of the working fluid at the inlet 22 may be monitored with a strain gauge (Omega, DP-25B-S) extending from a T-junction 28 (not shown) just prior to the inlet 22 of the rectifier 20, and the resulting flow rate of the working fluid through the outlet 24 may be measured using a hot wire anemometer.

Figure 5:
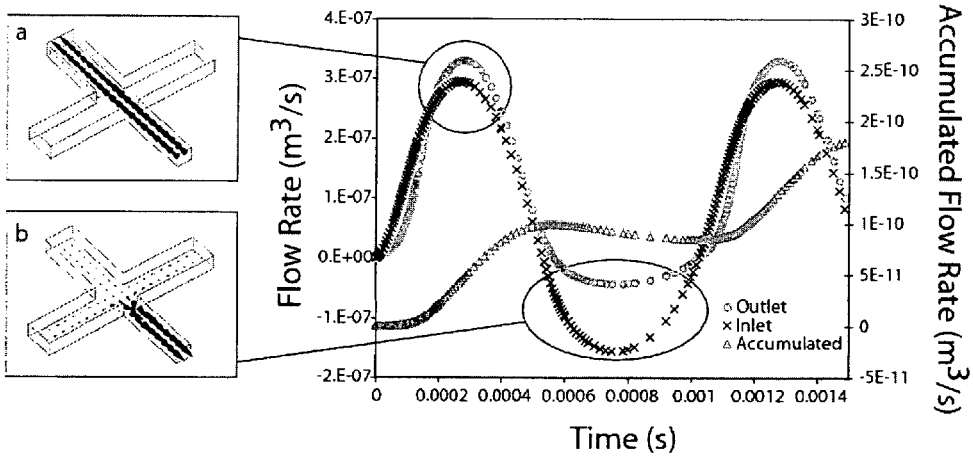
FIG. 5 provides a graph illustrating the results of three-dimensional transient simulation of accumulated directional flow through the outlet of a rectifier having a ratio of inlet diameter to outlet diameter of 0.5, with a 500 micron depth, with an inlet pressure amplitude of 1 kPa at a frequency of 1 kHz.

The experimentally obtained flow bias, for a pressure swing of 0.1 kPa, which correlates to a Reynold's number of about 100 for the system shown in FIG. 4, is illustrated for the inertial fluidic rectifier 20 by a pair of dissimilar blue shaded rectangles overlayed on the graph on the left side of FIG. 4 where the larger rectangle, for the case of positive applied pressure, represents the preferred flow direction. The vertically tiled images on the right side of FIG. 4 provide finite element method (FEM) simulation results for a simplified two-dimensional rectifier 20 of the same dimensions as the rectifier 20 whose simulated performance is illustrated in the graph of FIG. 4, and suggest the cause of the directional bias to be a difference in the resulting flow field for positive and negative inlet 22 pressures. For extremely low inlet 22 pressure swings, which correspond to working fluid flow having low Reynold's numbers of less than 1, the flow field is viscous dominant and perfectly reversible. Such flow is illustrated in the top two simulated images on the right side of FIG. 4, in which the Reynold's number is about 0.001, and is undesirable as no jet is formed with the flow of the working fluid from the inlet 22 into the outlet 24. Conversely, for higher inlet 22 pressures, which correspond to working fluid flow having high Reynold's numbers of at least 1, the flow field is inertial dominant, which leads to the formation of the synthetic jet of fluid flowing from the inlet 22 of the rectifier 20 toward the outlet 24. Such fluid flow is illustrated in the bottom two simulated images on the right side of FIG. 4. Over the course of multiple pressure cycles, the flow asymmetry when higher inlet 22 pressures, and thus higher Reynold's numbers of at least 1, are used produces a net accumulation of fluid flow at the outlet 24 of the rectifier 20. FIG. 5 provides an exemplary illustration of the accumulation profile of fluid flow at the outlet 24 of the rectifier 20. These results imply that by modulating pressure at the inlet 22 of the rectifier 20, made possible in this case by imposing the condition of resonance to the particular resonance chamber 12, fluid flow can be switched on and off at the outlet 24 of the rectifier 20. More specifically, during operation of the acoustical fluid control mechanism 10, the oscillating air pressure within the resonance chamber 12 serves as the input pressure to the rectifier 20, and the jet produced at the intersecting junction 28 creates a net positive flow at the outlet 24 of the rectifier 20.

As alluded to above, the directional bias can be introduced to the oscillatory flow of the working fluid through the port 16 either mechanically or by utilizing physical properties of the working fluid. For the embodiments of the rectifier 20 shown in FIGS. 3*a*-3*d*, as well as for the rectifier 20 that was used to generate the results shown in FIG. 4, the rectifier 20 is free from moving parts, e.g. valves, and relies upon physical properties of the working fluid for introducing the directional bias to the oscillatory flow of the working fluid. However, it is to be appreciated that the rectifier 20 may include additional mechanical features to assist with introducing the directional bias to the oscillatory flow of the working fluid.

The acoustical fluid control mechanism 10 may further comprise an acoustic source 32 for providing the acoustic signal 18 to the resonance chamber 12. When the bank of resonance chambers 12 is used, the acoustic source 32 may provide the acoustic signal 18 to the bank of resonance chambers 12. In this regard, a single acoustic source 32 may provide the acoustic signal 18 to the bank of resonance chambers 12. However, it is to be appreciated that the acoustic source 32 may be an external component that is not necessarily part of the acoustical fluid control mechanism 10. For example, a resonance chamber 12-rectifier 20 pair or bank of resonance chamber 12-rectifier 20 pairs may be provided as the entire acoustical fluid control mechanism 10, with an external acoustic source 32 used to effectuate operation of the acoustical fluid control mechanism 10.

Referring to FIG. 6, the acoustic source 32 may include an audio amplifier and a mid-range audio speaker. For purposes of scaling the acoustical fluid control mechanism 10 down for use in microfluidic systems, the acoustic source 32 may include a miniature diaphragm driver or a piezoelectric material (both not shown). In any event 26, the acoustic source 32 is capable of delivering an acoustic signal 18 containing a tone at a frequency that is substantially similar to the resonance frequency of the resonance chamber 12 at issue for purposes of effectuating oscillatory flow through the port 16, and is typically capable of delivering a composite acoustic signal 18 containing multiple different tones of different frequencies, i.e., chords, for purposes of simultaneously controlling the directional flow of the working fluid from multiple resonance chambers 12 when the bank of resonance chambers 12 is used. Further, the acoustic source 32 is capable of providing the acoustic signal 18 with sufficient strength to result in the resonance chamber 12 producing working fluid flow having an inertial dominant flow field. Those of skill in the art can readily determine an amplitude for the acoustic signal 18 to produce fluid flow having the desired Reynold's number.

When the bank of resonance chambers 12 is used, the acoustic signal 18 provided by the acoustic source 32 may be encoded to provide a sequence of tones for controlling fluid flow from the bank of resonance chambers 12, thereby enabling control of fluid flow from multiple resonance chambers 12 through the single encoded acoustic signal 18. In this regard, the tone contained in the acoustic signal 18 may be varied to independently control the directional flow of the working fluid from different resonance chambers 12. In one exemplary embodiment, the acoustic signal 18 may be controlled on a desktop PC using a LabVIEW virtual instrument package. In this embodiment, generation of an analog output signal 18 may be done using a National Instruments analog IO board (PCI-6031E). The analog output signal 18 from the IO board may be amplified using the audio amplifier such as an AMP100 from AudioSource 32. The amplified signal 18 may then be sent to a standard mid range audio speaker (e.g., a Pyle PDMW6 woofer) to thereby generate the acoustic signal 18 to which the resonance chamber(s) 12 is/are exposed. Components of the final assembled mechanism 10 may be bonded using an off the shelf RTV sealant.

Referring to FIG. 6, a common air chamber 34 that defines an air cavity 36 may be disposed between the audio amplifier and the bank of resonance chambers 12 for purposes of uniting the acoustic source 32 and the resonance chambers 12. However, it is to be appreciated that the common air chamber 34 may also be used when the acoustical fluid control mechanism 10 only includes a single resonance chamber 12. The common air chamber 34 provides an air reservoir that each resonance chamber 12 shares, and may be formed from glass. In one specific example, the common air chamber 34 may be formed from a 0.155 m segment of 0.152 m ID thick-walled glass. A cover plate 38 is typically disposed between the common air chamber 34 and resonance chamber(s) 12 to unite the same. In one specific embodiment, the cover plate 38 may be fabricated from a 0.155 m diameter, 0.01 m thick acrylic disc. Holes 40 may be formed in the cover plate 38 for mounting the resonance chamber(s) 12, with the holes 40 having a diameter about equal to the outer diameter of the resonance chamber(s) 12. Additionally, the cover plate 38 may define at least one vent hole 42 therein for preventing pressure buildup in the air cavity 36 of the common air chamber 34. The vent holes 42 may also minimize pressure cross talk between the resonance chambers 12 when the bank of resonance chambers 12 is used. In one specific example, as shown in FIG. 6, the cover plate 38 defines multiple vent holes 42, which are typically smaller than the holes 40 for mounting the resonance chamber(s) 12.

A method of controlling fluid flow of the working fluid with the acoustical fluid control mechanism 10 includes the step of exposing the resonance chamber 12 to the acoustic signal 18 containing the tone at about a particular resonance frequency of the resonance chamber 12 to produce oscillatory flow of the working fluid into and out of the cavity 14 of the resonance chamber 12 through the port 16. The frequency of the tone is typically equal to the particular resonance frequency of the resonance chamber 12. However, slight differences between the frequency of the tone and the particular resonance frequency of the resonance chamber 12 are acceptable so long as directional bias can be imparted to the resulting oscillatory flow of the working fluid by the rectifier 20. Typically, a maximum difference between the frequency of the tone contained in the acoustic signal 18 and the particular resonance frequency of the resonance chamber 12 to be exposed to the acoustic signal 18 is about 10 Hz. However, it is to be appreciated that the difference is highly dependent upon numerous factors, including strength of the acoustic signal 18, proximity of the acoustic source 32 to the resonance chamber 12, etc.

When the acoustical fluid control mechanism 10 includes the bank of resonance chambers 12, the acoustical fluid control mechanism 10 is capable of converting the composite or encoded acoustic signal 18 into multiple buffered pressure outputs, similar to what occurs in fiber optic electronic communication, for simultaneously or sequentially controlling the directional flow of the working fluid from multiple resonance chambers 12. Unlike known fluid control schemes, the acoustical fluid control mechanism 10 that includes the bank of resonance chambers 12 can independently regulate multiple output pressures from a single acoustic signal 18.

Figure 7:
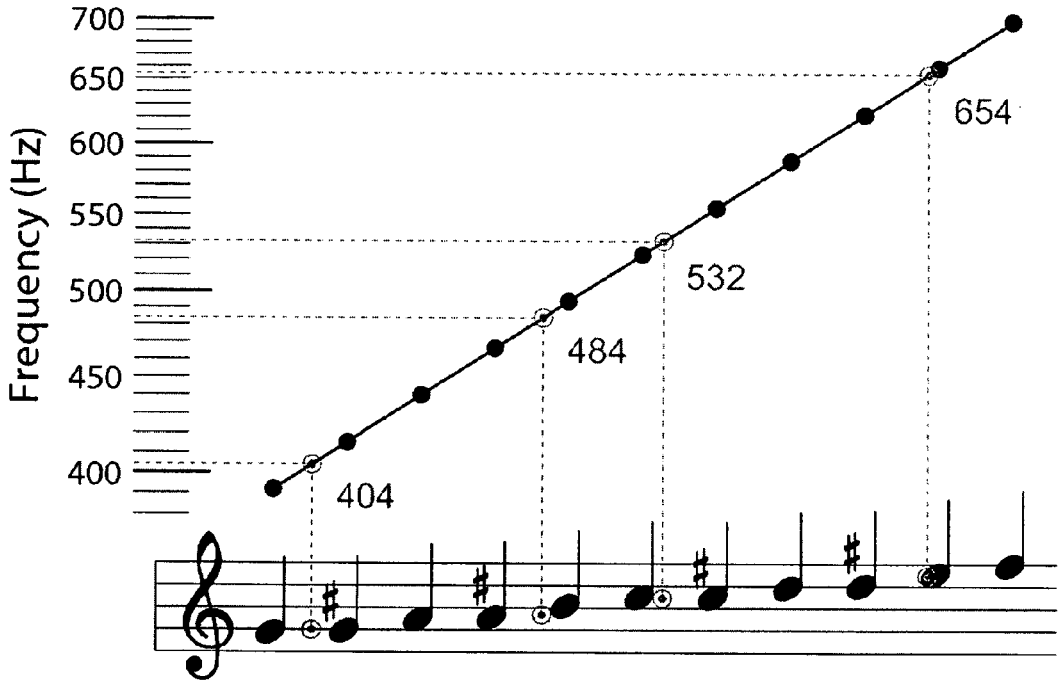
FIG. 7 illustrates exemplary resonance frequencies for four different resonance chambers mapped onto the chromatic scale. The chromatic scale is based on A4 at 440 Hz.
Figure 8:
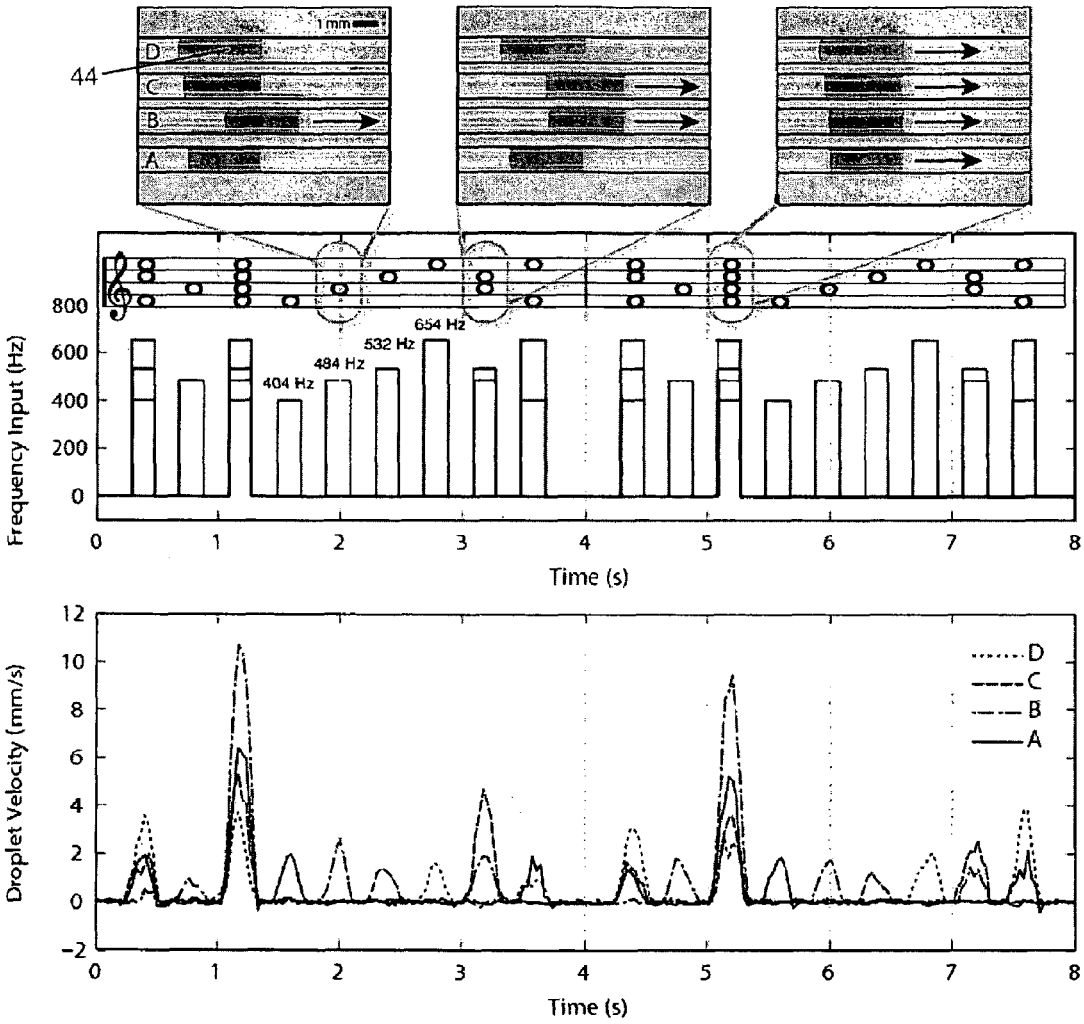
FIG. 8 presents a set of graphs representing a looped acoustic signal containing a sequence of tones and an inset (top) illustrating programmed droplet motion experiments corresponding to the acoustic signal. The inset (top) presents three images depicting droplet motion at different points in the looped acoustic signal. The middle graph represents the looped acoustic signal by approximate frequency positions on the chromatic scale. The bottom graph represents induced droplet velocity as a function of time and illustrates programmed actuation of specific droplets in response to exposure of the various resonance chambers to the acoustic signal containing the tones shown in the chromatic scale of the middle graph. Droplets are actuated singly or in concert, based on the tones contained in the acoustic signal.

In one specific application for which the acoustical fluid control mechanism 10 of the instant invention can be used, the outlet 24 of the rectifier 20 is connected to a fluidic channel containing a droplet 44 of liquid, and the directional flow of the working fluid from the outlet 24 of the rectifier 20 is used to actuate the droplet 44 contained in the fluidic channel. In this regard, the acoustical fluid control mechanism 10 of the instant invention can selectively actuate the droplet 44 in the fluidic channel using the acoustic signal 18 to control motion of the droplet 44 by way of the directional flow of the working fluid. When the bank of resonance chamber 12 is used, selective actuation of the droplets 44 may be accomplished using the composite or encoded acoustic signal 18 as described above. In one specific embodiment, the tones can be roughly correlated to notes on the chromatic scale as shown in FIG. 7, effectively enabling a musical sequence to be used as the composite or encoded acoustic signal 18. The composite or encoded acoustic signal 18 is delivered to the bank of resonance chambers 12, with each resonance chamber 12 including the rectifier 20 attached thereto. The resonance chamber 12-rectifier 20 pairs decode the composite or encoded signal 18 into a set of discrete pneumatic signals 18. For example, as shown in FIG. 8, the composite or encoded acoustic signal 18 containing the sequence of tones, illustrated on the chromatic scale, is delivered to the resonance chamber 12-rectifier 20 pairs using the computer and audio amplifier. The bank of resonance chambers 12 having different resonance frequencies (in this specific example, four cavities having resonance frequencies at 404 Hz, 484 Hz, 532 Hz and 654 Hz, respectively) is exposed to the composite or encoded acoustic signal 18, and the outlet 24 flow rate of fluid from each resonance chamber 12-rectifier 20 pair is monitored using a hot-wire anemometer (not shown). Even though all resonance chambers 12 are exposed to the same signal 18, individual resonance chambers 12 selectively amplify the tones having the frequency that corresponds to the particular resonance frequency of the resonance chamber 12. The rectifiers 20 attached to the respective resonance chambers 12 then introduce directional bias to the oscillatory flow of the working fluid, resulting in the transmission of directional flow of the working fluid through the outlet 24 of the rectifier 20. The resonance chambers 12 are insensitive to the presence of other competing tones having frequencies different than the particular resonance frequency thereof, thereby enabling selective control of droplets 44 in different fluidic channels that are connected to different resonance chambers 12.

As shown in the top images of FIG. 8, the directional flow of the working fluid through the outlet 24 of the rectifier 20 for any particular resonance chamber 12-rectifier 20 pair can be exploited to actuate the droplet 44 contained in the fluidic channel. For the purpose of graphical clarity in FIG. 8, as well as to demonstrate the flow control capabilities of the acoustical fluid control mechanism 10 of the instant invention, the output flow rate of each resonance chamber 12-rectifier 20 pair was set to the same value in this specific example. In the Example illustrated by FIG. 8, four resonance chamber 12-rectifier 20 pairs were connected to four separate fluidic channels, respectively, with each fluidic channel having 1 mm inner diameter capillary channels. Each fluidic channel contained a droplet 44 of a liquid with a volume of about 3 micro liters. The liquid was water with added color, and there was no appreciable change in the viscosity of the water due to the added color. The droplets 44 were actuated by delivering the composite or encoded acoustic signal 18 comprising the sequence of tones to the resonance chamber 12-rectifier 20 pairs, each tone having a frequency generally correlated to the resonance frequency of one of the resonance chambers 12 as shown in FIG. 7 and, thus, responsible for the motion of one droplet 44. The sequence of notes was played, with monotonic or chord notes contained in the sequence of notes as shown in FIG. 8. The sequence of notes only produced motion of droplets 44 in fluidic channels attached to resonance chamber 12-rectifier 20 pairs having a resonance frequency correlated to the frequency of the particular notes played. Additionally, movement of the droplets 44 was nearly instantaneous in response to changes in the composite or encoded acoustic signal 18 as the sequence of notes was played. Tone durations in this experiment were relatively brief (less than about 0.5 seconds), amounting to droplet 44 displacements on the order of half a millimeter per pulse. However, computerized waveform construction allows for full customization of the composite or encoded acoustic signal 18, thereby allowing a droplet 44 to be moved over a longer distance in a shorter period of time by increasing the amplitude of the corresponding tone and thus increasing the acoustic pressure within the cavity 14 of the resonance chamber 12 of interest. It is notable that for notes played as chords, droplet 44 velocities are higher than velocities produced from notes played monotonically. These phenomena can be controlled by adjusting tone amplitudes.

The acoustical fluid control mechanism 10 presented herein may be scaled down to develop an on-chip version thereof and thereby enable the operation of complex lab-on-a-chip (LOC) devices using minimal external control hardware. The acoustical fluid control mechanism 10 may be readily integrated into existing microfluidic designs or coupled to existing devices through an intermediate routing layer. Decrease in the length scale of the resonance chambers 12 will cause a proportional increase in resonance frequency and a four-fold increase in hydraulic resistance. Due to the increased power demands imposed by hydraulic resistance, higher pressures in the resonance chambers 12 may be useful to achieve the inertial dominant flow that is desirable for operation of the acoustical fluid control mechanisms 10. Piezoelectric bi-morph materials are excellent candidates for on-chip acoustic sources 32 as they are powerful (i.e. have large mechanical impedance), can be fabricated in various sizes and shapes, and have a wide range of customizable performance characteristics such as driving voltage, strain, displacement, and dynamic range. Delivery of the acoustic signal 18 to the resonance chambers 12 in on-chip versions of the acoustical fluid control mechanisms 10 could be accomplished by direct displacement of a flexible microcavity volume using the piezoelectric bi-morph materials. Alternatively, the acoustic signal 18 could be transported through a working fluid (i.e., liquid or gas) to the chip. In either case, it is desirable to minimize radiation losses of the resonance chambers 12 and acoustic source 32 to prevent 26 attenuation of the acoustic signal 18.

The invention has been described in an illustrative manner, and it is to be appreciated that the terminology which has been used is intended to be in the nature of words of description rather than of limitation. Obviously, many modifications and variations of the present invention are possible in view of the above teachings. It is, therefore, to be appreciated that within the scope of the claims the invention may be practiced otherwise than as specifically described, and that the reference numerals are merely for convenience and are not to be in any way limiting.

The invention claimed is:

1. An acoustical fluid control mechanism comprising:

a resonance chamber defining a cavity and having a port with the cavity sealed from the ambient but for said port for enabling oscillatory flow of a working fluid into and out of the cavity upon exposure of said resonance chamber to an acoustic signal containing a tone at a frequency that is substantially similar to a particular resonance frequency of said resonance chamber; and a rectifier for introducing directional bias to the oscillatory flow of the working fluid through said port, said rectifier having an inlet connected to said port of said resonance chamber for receiving the oscillatory flow of the working fluid from said port and an outlet for transmitting the directional flow of the working fluid away from said cavity, wherein said outlet is in fluid communication with said port of said resonance chamber at least during transmission of the directional flow of the working fluid therethrough.

2. An acoustical fluid control mechanism as set forth in claim 1 wherein said rectifier comprises an intersecting junction with said inlet, said outlet, and a vent meeting at said intersecting junction.

3. An acoustical fluid control mechanism as set forth in claim 1 wherein said inlet of said rectifier has a smaller cross-sectional area than said outlet.

4. An acoustical fluid control mechanism as set forth in claim 1 wherein said inlet and outlet are disposed opposite to each other across said intersecting junction.

5. An acoustical fluid control mechanism as set forth in claim 1 wherein said rectifier is free from moving parts.

6. An acoustical fluid control mechanism as set forth in claim 1 wherein a ratio of a cross-sectional area of said resonance chamber to a cross-sectional area of said port is at least 4.0:1.

7. An acoustical fluid control mechanism as set forth in claim 1 further comprising an acoustic source for providing the acoustic signal to said resonance chamber.

8. An acoustical fluid control mechanism as set forth in claim 1 comprising a bank of said resonance chambers each having a different resonance frequency with a rectifier connected to said port of each resonance chamber.

9. An acoustical fluid control mechanism as set forth in claim 8 wherein a peak resonance frequency of any of said resonance chambers is different by at least 10 Hz from a peak resonance frequency of any other of said resonance chambers.

10. An acoustical fluid control mechanism as set forth in claim 8 wherein a single acoustic source provides the acoustic signal to said bank of resonance chambers.

11. An acoustical fluid control mechanism as set forth in claim 8 further comprising a common air chamber defining an air cavity disposed between said acoustic source and said bank of resonance chambers.

12. An acoustical fluid control mechanism as set forth in claim 11 further comprising a cover plate disposed between said common air chamber and said bank of resonance chambers to unite the same.

13. An acoustical fluid control mechanism as set forth in claim 12 wherein said cover plate defines at least one vent hole therein for preventing pressure buildup in the air common air chamber.

14. A method of controlling fluid flow of a working fluid with the acoustical fluid control mechanism as set forth in claim 1, said method comprising the step of exposing the resonance chamber to an acoustic signal containing a tone at a frequency that is substantially similar to a particular resonance frequency of the resonance chamber to produce oscillatory flow of the working fluid into and out of the cavity of the resonance chamber through the port with the rectifier thereby introducing directional bias to the oscillatory flow of the working fluid through the port and resulting in transmission of directional flow of the working fluid away from the cavity and through the outlet of the rectifier.

15. A method as set forth in claim 14 wherein the outlet of the rectifier is connected to a fluidic channel containing a droplet of liquid and wherein the method further comprises the step of actuating the droplet contained in the fluidic channel with the directional flow of the working fluid from the outlet of the rectifier.

16. A method as set forth in claim 14 wherein the acoustical fluid control mechanism comprises a bank of the resonance chambers each having a different resonance frequency with a rectifier connected to the port of each resonance chamber, and wherein each resonance chamber is exposed to the same acoustic signal.

17. A method as set forth in claim 16 further comprising the step of exposing the bank of resonance chambers to the same acoustic signal.

18. A method as set forth in claim 17 further comprising the step of varying the tone contained in the acoustic signal to independently control the directional flow of the working fluid from different resonance chambers.

19. A method as set forth in claim 16 wherein the acoustic signal is further defined as a composite acoustic signal containing multiple different tones for simultaneously controlling the directional flow of the working fluid from multiple resonance chambers.

20. A method as set forth in claim 14 wherein the oscillatory flow of the working fluid has an inertial dominant flow field.

* * * * *

UNITED STATES PATENT AND TRADEMARK OFFICE

CERTIFICATE OF CORRECTION

PATENT NO. : 8,636,032 B2
APPLICATION NO. : 13/129276
DATED : January 28, 2014
INVENTOR(S) : Burns et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 432 days.

Signed and Sealed this
Twenty-first Day of July, 2015

Michelle K. Lee

Michelle K. Lee
*Director of the United States Patent and Trademark Office*